US007299777B2

(12) United States Patent
Meisborn et al.

(10) Patent No.: US 7,299,777 B2
(45) Date of Patent: Nov. 27, 2007

(54) FASTENING OF A BEARING BOLT TO A ROLLER TAPPET

(75) Inventors: Marco Meisborn, Höchstadt a.d. Aisch (DE); Mario Kuhl, Herzogenaurach (DE)

(73) Assignee: Schaeffler KG, Herzogenaurach (DE)

( * ) Notice: Subject to any disclaimer, the term of this patent is extended or adjusted under 35 U.S.C. 154(b) by 55 days.

(21) Appl. No.: 11/360,259

(22) Filed: Feb. 23, 2006

(65) Prior Publication Data

US 2006/0288974 A1 Dec. 28, 2006

Related U.S. Application Data

(60) Provisional application No. 60/657,044, filed on Feb. 28, 2005.

(51) Int. Cl.
*F01L 1/14* (2006.01)

(52) U.S. Cl. ..... 123/90.48; 123/90.52; 123/90.45

(58) Field of Classification Search ..... 123/90.39, 123/90.44, 90.45, 90.46, 90.48, 90.52, 90.55
See application file for complete search history.

(56) References Cited

U.S. PATENT DOCUMENTS 6,196,175 B1 3/2001 Church
6,382,173 B1 * 5/2002 Roe ..... 123/198 F

* cited by examiner

*Primary Examiner*—Ching Chang
(74) *Attorney, Agent, or Firm*—Volpe and Koenig, PC

(57) ABSTRACT

A connection of a bearing bolt (6) in a cylindrical housing (1) of a roller tappet (2) that is actuated in a direction of a longitudinal axis (Z) is provided, especially for a tappet push-rod valve drive of an internal combustion engine. The bearing bolt (6) is supported in bore holes (7) of the housing (1), which extend in a transverse plane (XY) to the roller tappet (2), perpendicular to the longitudinal axis (Z), and is connected with a positive and/or non-positive fit to the housing (1) through material deformation. The material deformation is provided as one or more segments (9, 10), of which at least one segment (9) completely encloses a radial load zone (16) of the bearing bolt (6), and a section (15) of the bearing bolt (6) extending about the transverse plane (XY) is free from material deformation.

5 Claims, 1 Drawing Sheet

FASTENING OF A BEARING BOLT TO A ROLLER TAPPET

BACKGROUND

The invention relates to fastening of a bearing bolt in a cylindrical housing of a roller tappet actuated in the direction of a longitudinal axis, especially for a tappet push-rod valve drive of an internal combustion engine. The bearing bolt is supported in bore holes of the housing, which extend in a transverse plane to the roller tappet, perpendicular to the longitudinal axis and connected to the housing with a positive and/or non-positive fit through material deformation as a result of end-side swaging of the bearing bolt in the direction of the housing.

The fastening of bearing bolts in housings of roller tappets by means of end-side swaging or stamping of the bearing bolt with the housing has been known to someone skilled in the art for a long time as a time-saving and cost-effective measure to connect the bearing bolt to the housing of the roller tappet in a functionally reliable and long-term manner. For example, U.S. Pat. No. 6,196,175 B1 shows a roller tappet valve drive with a roller tappet that is here embodied as a switchable roller tappet for deactivating the gas-exchange valve. A good view of a typical swaging pattern can be seen at the end of the bearing bolt. This pattern results from the material-deforming effect of a stamping tool in the region of the radial end of the bearing bolt. Such a swaging pattern often has the shape of a continuous circular groove, which is formed in the end side of the bearing bolt by the stamping tool, which wobbles about the axis of the bearing bolt, for example, under the application of force. As described in the cited document, this material deformation can also be composed of numerous circular arc-shaped segments, which alternate with non-deformed, but relatively short sections.

Fixation of the bearing bolt embodied in this way can be disadvantageous for several reasons. First, the bearing bolt is frequently used as a support for a highly stressed cam roller of a roller tappet in internal combustion engines with a roller tappet valve drive and underlying camshaft. The diameter of such a roller tappet is typically based directly on the diameter and width of the cam roller and is kept as small as possible for reasons of the moving valve drive mass. This has the result that the cam roller is held either in a roller pocket of the roller tappet, wherein the roller pocket is closed on the periphery but locally has very thin walls, or is arranged merely between two axial connecting pieces of the housing for supporting the bearing bolt.

However, in both cases the radial inherent stability of the housing of the roller tappet is considerably limited in the region of the cam roller. In this respect, material deformation, which extends continuously past the end periphery of the bearing bolt or which is distributed uniformly, with a high percentage of deformed segments has the result that the originally cylindrical housing in the region of the cam roller is deformed to be unacceptably high and typically oval after the swaging process due to the material deformation extending in the radial direction of the housing.

Such shape deformation can be problematic, especially in the roller tappet valve drives of the type noted above, whose roller tappets are typically manufactured from steel and supported in a guide of the internal combustion engine composed from gray iron. This is due to the very similar thermal expansion coefficients of steel and gray iron, so that advantageously a largely temperature-independent and thus extremely small guidance play of the roller tappet in its guide can be realized. However, shape deformation of the housing with already very small deviations from the cylindrical form can simultaneously have the result that the roller tappet can be installed during the assembly process either not at all or only under tamping into the guide, or that the roller tappet jams in the guide when the engine is running. Possible consequences of the latter case include, in the best case, a gas-exchange valve that no longer closes completely and, in the worst case, engine damage due to mechanical valve-drive stress or due to a piston colliding with an open gas-exchange valve.

Another disadvantage of the known connection of the bearing bolt by means of swaging is that continuous or uniformly distributed material deformation with a high percentage of deformed segments leads to minimal local material deformation of the bearing bolt for constant stamping forces, whereby the security against detachment of the connection of the bearing bolt to the housing of the roller tappet is reduced. In addition, material deformation, as embodied in the cited document as a plurality of segments alternating with non-deformed sections, is rated as unfavorable with reference to the press fit between the end section of the bearing bolt and the associate bore hole of the housing. The cause of this is a non-uniform force distribution in the force fit. The non-uniform force distribution can lead to excessive material stresses in the region of the load zone formed on the bearing bolt due to the introduction of forces via the cam roller and consequently to a flow of bearing bolt material in the force fit in the region of the load zone, because the bearing bolt at the end sections exhibits a relatively low material hardness for the purpose of deformation. In the case of such material flow, the security against detachment of the fixation of the bearing bolt is also reduced. A connection that is no longer effective typically leads to friction-generating contact of the bearing bolt with the guide due to the bearing bolt coming out of the housing at the sides. This can lead to destruction of the guide sleeve and subsequent jamming of the roller tappet in the guide in a short time with the consequences and damages explained above.

SUMMARY

Therefore, with respect to the known state of the art, the invention is based on the objective of creating a fixation of a bearing bolt to a roller tappet, which is produced with the established assembly method of swaging, and for increased security against detachment of the connection, guarantees the smallest possible radial shape deformation of the cylindrical housing holding the bearing bolt.

According to the invention, this objective is met in that the material deformation is provided as one or more segments, of which at least one segment completely encloses a radial load zone of the bearing bolt, wherein a section of the bearing bolt about the transverse plane is free from material deformation. With the fixation of the bearing bolt embodied in this way, different requirements on the positive and/or non-positive fit connection of the bearing bolt to the housing of the roller tappet can be fulfilled simultaneously.

First, the radial load zone of the bearing bolt is located completely on one segment of the material deformation, so that the security against detachment of the connection by a force fit that is uniform in the load zone between the bearing bolt and the corresponding bore hole of the housing is guaranteed in that the material flow explained above is effectively prevented due to non-uniform force distribution with impermissibly high material stresses in the region of the load zone.

Second, a section of the bearing bolt extending about the transverse plane is free from material deformation, so that the radial shape deformation of the housing is negligible or at least can be kept within very tight acceptable limits. Finally, the forces of the stamping tool can be reduced for a constant local material deformation of the bearing bolt. Alternatively, it is obviously also possible for unchanged forces of the stamping tool to increase the local material deformation for otherwise non-critical shaped deformation of the housing in terms of further increased security against detachment of the fixation. In both cases, a press fit is produced, which also acts as a positive fit and consequently further increases the security against detachment of the connection due to torque transmitted to the bearing bolt. This press fit is distributed non-uniformly over the periphery of the bearing bolt. The torque results from friction forces of the roller or cylinder body rotating about the bearing bolt and stresses the bearing bolt in its peripheral direction.

In a useful improvement of the invention, the segment surrounding the radial load zone of the bearing bolt has a circular arc shape. In this way, in an especially preferred configuration of the invention, the material deformation includes two segments extending symmetric to the transverse plane. It is further proposed that these segments each enclose an angle of 120° in order to achieve the greatest possible security against detachment of the fixation and for simultaneously low shape deformation of the housing.

Finally, the roller tappet is embodied as a switchable roller tappet for deactivating one or more gas-exchange valves of the internal combustion engine. For such roller tappets known to the technical world, deviations from the cylindrical shape of the housing of the roller tappet are to be kept within very tight limits, because the roller tappet in the deactivated state is then no longer restored by the force of the gas-exchange valve spring, but instead by a considerably less powerful, so-called lost-motion spring in the direction of the cam shaft of the internal combustion engine. The resulting increase of the jamming tendency of the roller tappet in its guide is at least compensated by the very low shape deformation of the housing.

Nevertheless, the invention shall not be limited to roller tappets in valve drives. In this respect, roller tappets, which are used, for example, as cam followers in fuel pump devices, are also included in the scope of protection.

BRIEF DESCRIPTION OF THE DRAWINGS

Additional features of the invention follow from the description below and from the drawings, in which the fixation of the bearing bolt according to the invention is shown as an example with reference to a roller tappet for a roller tappet valve drive of an internal combustion engine. The fixation of the bearing bolt is symmetric to a longitudinal axis of the roller tappet and, if not explicitly mentioned otherwise, is described and provided with reference symbols for only one side of the bearing bolt. Shown are.

DETAILED DESCRIPTION OF THE PREFERRED EMBODIMENTS

Figure 1:
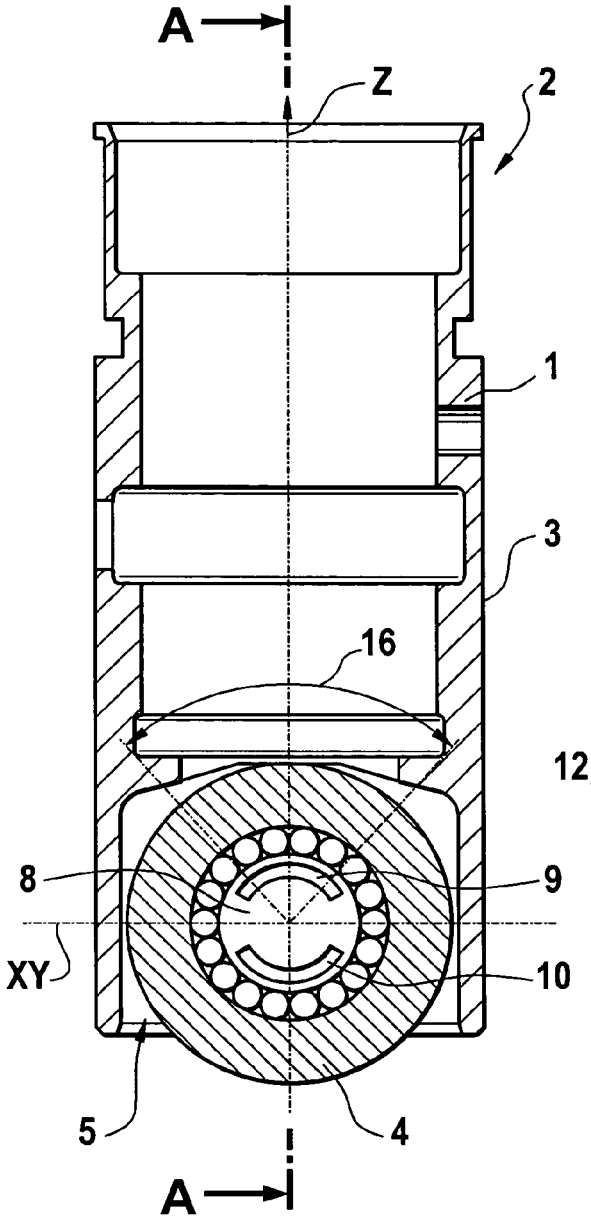
FIG. 1 a longitudinal section through a housing of the roller tappet, wherein the bearing bolt is shown on its end in a non-sectioned top view and FIG. 2 a cross-sectional view through the housing according to the section cut A-A from FIG. 1.
Figure 2:
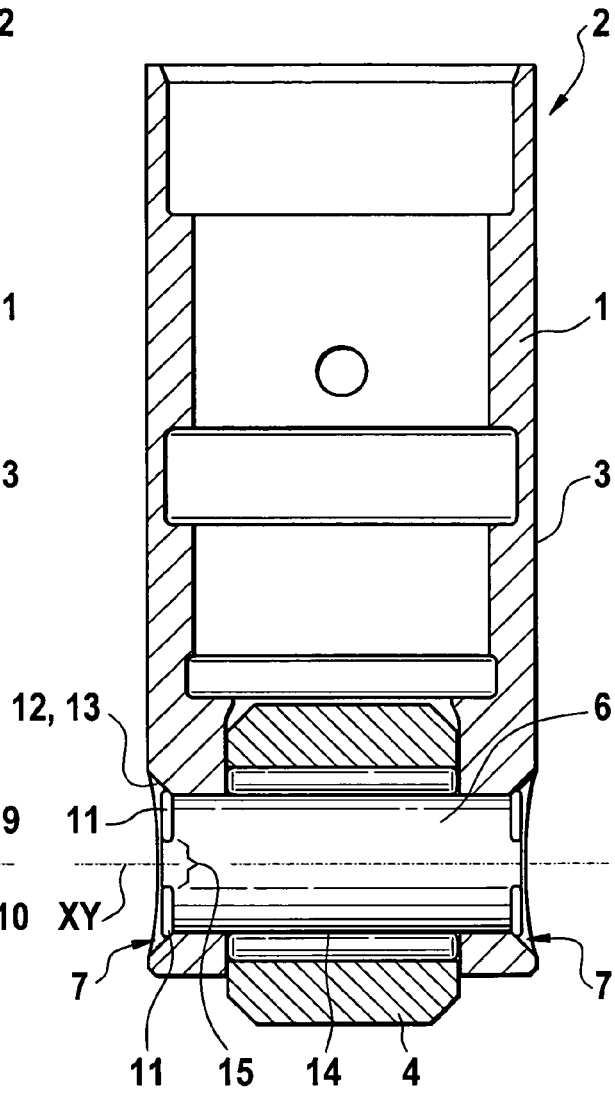

In the figures, a cylindrical housing 1 of a sub-assembly of a roller tappet 2 for a roller tappet valve drive of an internal combustion engine is shown. The housing 1 is actuated in the direction of a longitudinal axis Z with an outer jacket 3 in a not-shown hollow cylindrical guide of the internal combustion engine. A roller bearing-supported roller 4, which is arranged in a roller pocket 5 of the housing 1, is used for low-friction following of a similarly not-shown cam of the internal combustion engine. The roller 4 is supported by a bearing bolt 6, which is held on both sides in a bore hole 7 that extends between the outer jacket 3 and roller pocket 5. The bore holes 7 each extend in a transverse plane XY of the roller tappet 2, perpendicular to the longitudinal axis Z. The connection of the bearing bolt 6 is achieved by material deformation, which is generated by means of axial swaging or stamping, which starts from one end 8 of the bearing bolt 6, and which connects the bearing bolt 6 with a positive and non-positive fit to the housing 1. In FIG. 1, a good view of a stamping pattern in the form of circular arc-shaped segments 9 and 10 can be seen.

The bearing bolt 6 is expanded in the radial direction due to the swaging or stamping in the regions of the segments 9 and 10, whereby in these regions a force fit is created between the bearing bolt 6 and the bore hole 7. In addition, this creates in the regions of the segments 9 and 10 a radially projecting bead 11, which is supported in a transition region 13 formed as a circular bevel 12 between the outer jacket 3 and the bore hole 7, and which generates a positive fit axial connection of the bearing bolt 6 to the housing 1. A prerequisite for the material deformation of the end 8 is an axial hardness profile, which transitions from a relatively soft and thus deformable material of the bearing bolt 6 in the region of the end 8 into a central region, which acts as a race 14 for the roller bearing-supported roller 4 and which has a higher hardness and wear resistance.

A section 15 extending between the segments 9 and 10, as well as around the transverse plane XY, is free from material deformation due to the swaging or stamping. Consequently, neither the previously described force fit between the bearing bolt 6 and bore hole 7 nor the bead 11 supported in the bevel 12 are formed in this section 15. Therefore, viewed on the transverse plane XY, a shape deviation of the cylindrical outer jacket 3 of the housing 1 in the region of the roller pocket 5 can be kept to a minimum.

Simultaneously, the force fit generated only locally in the region of the segments 9 and 10 also has a positive-fit action in order to give additional support to the security against detachment of the fixation due to a torque transmitted to the bearing bolt 6.

FIG. 1 further shows a load zone 16, which acts on the bearing bolt 6 due to a force from the roller 4 oscillating relative to its force application angle. In this way, the changing application angle of the force follows a variable-angle contact point between the roller 4 and rotating cam. Consequently, a prerequisite for a functionally secure and long term fixation of the bearing bolt 6 on the housing 1 is the most uniform radial expansion of the bearing bolt 6 in the region of this load zone 16, in order to achieve the most homogeneous force distribution between the bearing bolt 6 and the support bore hole 7 in the region of the load zone 16. For this reason, the load zone 16 is completely enclosed by the segment 9, which is away from the cam and shown in FIG. 1 above the transverse plane XY. An angle of the circular arc-shaped segments 9 and 10 each of approximately 120° has emerged as an optimum compromise between the best security against detachment of the connection of the bearing bolt 6 with the lowest possible shape deformation of the housing 1 in the region of the roller pocket 5 in the direction of the transverse plane XY.

LIST OF REFERENCE NUMBERS AND SYMBOLS

1 Housing
2 Roller tappet
3 Outer jacket surface
4 Roller
5 Roller pocket
6 Bearing bolt
7 Bore hole
8 End side
9 Segment
10 Segment
11 Bead
12 Bevel
13 Transition region
14 Raceway
15 Section
16 Load zone
Z Longitudinal axis
XY Transverse plane

The invention claimed is:

1. A connection for a bearing bolt (6) in a cylindrical housing (1) of a roller tappet (2) that is actuated in a direction of a longitudinal axis (Z) for a tappet push-rod valve drive of an internal combustion engine, a connector comprises the bearing bolt (6) supported in bore holes (7) of the housing (1), which run in a transverse plane (XY) to the roller tappet (2) perpendicular to a longitudinal axis (Z) and connected with a positive and/or non-positive fit to the housing (1) through material deformation due to end swaging or stamping of the bearing bolt (6) in a direction of the housing (1), the material deformation is provided as one or more segments (9, 10), of which at least one segment (9) completely encloses a radial load zone (16) of the bearing bolt (6), wherein one section (15) of the bearing bolt (6) extending about the transverse plane (XY) is free from material deformation.

2. The connector of a bearing bolt according to claim 1, wherein the one or more segments (9) have a circular arc shape.

3. The connector of a bearing bolt according to claim 2, wherein the material deformation includes two segments (9, 10) located symmetric to the transverse plane (XY).

4. The connector of a bearing bolt according to claim 3, wherein the segments (9, 10) each enclose an angle of 120°.

5. The connector of a bearing bolt according to claim 1, wherein the roller tappet (2) comprises a switchable roller tappet for deactivating one or more gas-exchange valves of the internal combustion engine.

* * * * *